United States Patent [19]

Neal et al.

[11] 4,428,213

[45] Jan. 31, 1984

[54] DUPLEX PEENING AND SMOOTHING PROCESS

[75] Inventors: James W. Neal, Columbia; Joseph W. Sullivan, Glastonbury; Joseph F. Loersch, Bolton, all of Conn.

[73] Assignee: United Technologies Corporation, Hartford, Conn.

[21] Appl. No.: 300,723

[22] Filed: Sep. 10, 1981

[51] Int. Cl.[3] ..... C21D 7/06; F01D 5/14

[52] U.S. Cl. ..... 72/53; 416/223 R

[58] Field of Search ..... 72/53, 40; 29/23.5, 29/556.8 R, 556.8 B; 416/223 R

[56] References Cited

U.S. PATENT DOCUMENTS

| | | | |
|---|---|---|---|
| 937,180 | 10/1909 | Ridd | 72/53 |
| 3,073,022 | 1/1963 | Bush et al. | 72/53 |
| 3,482,423 | 12/1969 | Murray | 72/53 |
| 3,668,913 | 6/1972 | Morris | 72/53 |
| 3,705,511 | 12/1972 | Brandel | 72/53 |
| 4,034,585 | 7/1977 | Straub | 72/53 |

OTHER PUBLICATIONS

Metal Improvement Co. "Shot Peening Applications" 6th Ed. (1980) p. 35.

*Primary Examiner*—Gene P. Crosby

*Attorney, Agent, or Firm*—C. G. Nessler

[57] ABSTRACT

Disclosed is a two step process of peening for workpieces having small radii fillets or fragile edges, such as gas turbine airfoils have. In the first step, relatively small size shot of less than 1 mm dia is used to impart a first peening intensity to a workpiece. This results in a first relatively rough surface finish. In the second step, shot of substantially uniform diameter in the range 1–2.5 mm is impacted with uniform velocity to provide a surface finish smoother than 30AA ($10^{-6}$ inch). When fillets are peened, improved fatigue life results from the duplex process. When used on edges, where direct edge impact is avoided in the second step, deformed edges are avoided by the process. Yet the workpiece is substantially smooth and the edges have the requisite residual stress distribution.

9 Claims, 5 Drawing Figures

DUPLEX PEENING AND SMOOTHING PROCESS

DESCRIPTION

Technical Field

The present invention relates to the peening of workpieces, particularly those having relatively small internal contours of their surfaces.

Background

Specification AMS 2430 (Aerospace Materials Specification, Society of Automotive Engineers) and related U.S. Military Specification MIL-S-131658 set forth requirements which are applied particularly to the manufacture of parts for aircraft engines where peening is used to improve fatigue strength. The shot peening intensity is chosen according to the requirements of the user for the depth of compressive stressing needed in the part. If parts are simply flat panels, and the shot stream is impinged on the surface at substantially a 90° angle, compliance with the specification is straightforward. However, most products are not smooth, flat plates. Of particular interest is peening of components where there are fillets and other inside radius contours, where stresses tend to be concentrated. An example is a gas turbine blade having a fillet where the airfoil joins the platform. Other examples are the "fir-tree" roots of gas turbine airfoils and transmission gears, piston heads, and connecting rods of internal combustion engines.

The specification AMS 2430 requires that the nominal diameter of the shot being used not be greater than half the smallest nominal fillet radius. The reason for the specification limitation is that when too large shot is used, a lower shot peening intensity is obtained compared to that obtained on flat surfaces. The use of large 1–2.5 mm shot is disclosed in a related application Ser. No. 300,725 "Method for Simultaneous Peening and Smoothing", filed on even date herewith, and having some inventors in common. When the related peening method is applied to parts such as gas turbine blades, it is sometimes found the large shot does not conform with AMS 2430. Also, when large shot is impacted on thin edged workpieces, unless there is careful control of the shot impact angle and location, there can be gross distortion of deformation of the edges.

SUMMARY OF THE INVENTION

An object is to provide a method for peening contoured and thin edged workpieces, while also providing them with the stress distribution and finish which large diameter shot permits.

According to the invention, workpieces are peened in a duplex process, i.e., in two steps. The first step utilizes relatively small diameter shot, of less than 1 mm, and provides a basic state of residual stress to the workpiece and a surface finish rougher than 30 AA. The second step utilizes relatively large (1–2.5 mm dia) spherical shot, having substantially uniform diameter, mass and velocity, and provides some additional compressive stresses, but mainly it provides a surface smoother than 30 AA on most parts of the airfoil.

When the invention is applied to gas turbine blades and the like which have fillets, the first peening may alternatively be only to the critical fillet region, or it may be to the entire airfoil. When the first peening is applied to the fillet region only, then the second peening must be of such intensity as desired throughout the airfoil. In the fillet, the second peening provides smoothness and evidently some additional stressing, even though the shot is large and therefore inherently less effective, in accord with commercial specifications relating shot size to fillet radius. Fatigue tests show that airfoils with duplex peening have better properties than blades peened by either the first or second step alone.

Duplex peening is also applied to airfoils having fragile edges. The first peening step using small diameter shot generally is applied to the entire surface of the airfoil including the edges using such intensity as is described in the part. The second step is applied using an oscillatory motion of the airfoil described in another application, to avoid large shot impacts directly on the fragile edges. There is some indirect impact and desirable smoothing of the edges, but they obtain the desired residual stress state primarily from the first peening step.

The foregoing and other objects, features and advantages of the present invention will become more apparent from the following description of the preferred embodiments and accompanying drawings.

BEST MODE FOR CARRYING OUT THE INVENTION

The invention is described in terms of the peening of a titanium alloy (Ti-6 Al-4 V) blade for the compressor section of a gas turbine engine. However, the invention will be found equally useful for other parts having fillets, contours, or thin edges.

Figure 1:
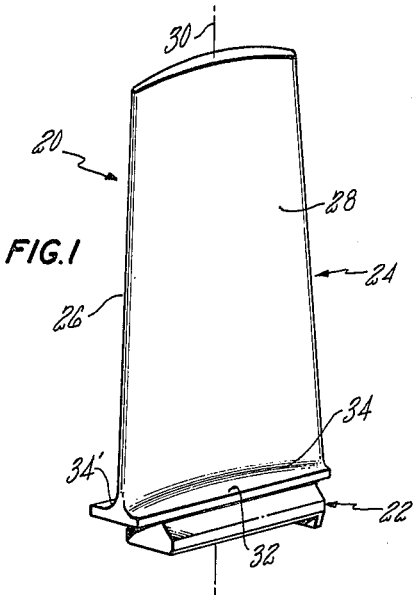
FIG. 1 shows generally a compressor blade for use in a gas turbine engine.

FIG. 1 shows a typical gas turbine blade 20. The blade has a root portion 22 and an airfoil portion 24. The airfoil portion has opposing airfoil surfaces 26, 28 lying about the longitudinal axis 30 of the blade. A platform 32 extends essentially transverse to the longitudinal axis of the airfoil. Connecting the platform and airfoil surfaces are fillets 34, 34'. A typical airfoil is about 3.8 by 7.6 cm in overall dimension and the fillet radius is about 1.8 mm.

In related application Ser. No. 300,726 "Shot Peening Apparatus" equipment is described which enables the combined shot peening and smoothing process to be carried out. In another related application, Ser. No. 300,718 "Method of Peening Airfoils and Thin Edged Workpieces", procedures are described by which airfoils may be manipulated to obtain good peening of their complex contoured surfaces. The disclosures of the foregoing applications, and application Ser. No. 300,725 mentioned in the background, are hereby incorporated by reference.

To summarize the related disclosures, 1.8 mm uniform sized spherical steel shot (called NL-18 shot) is impacted on the workpiece at a velocity of about 3.5–4 m/s preferably by dropping it from a height and allowing it to fall by gravity until it strikes the workpiece. The preferred parameters include uniform sized steel shot in the range of 1–2 mm, and peening intensity, I, in the range of 0.25–0.30 N. (N represents the peening intensity as measured by an Almen type strip in the N range, in millimeters.) The airfoil is oscillated during peening. To peen the platform region as well as the airfoil region, the airfoil surface is inclined at an angle C, usually of about 15°, to the normal of the shot streamline, so that the shot 36 may strike both the platform and the airfoil at an oblique angle. See FIG. 2. In doing so, the steel shot will tend to strike into the fillet region. However, owing to the shape of the fillet in combination with the size of the NL-18 steel shot, it will be found that the peening intensity will tend to be lower than is obtained on the airfoils.

Therefore, the following step is employed prior to the just mentioned peening with NL-18 shot. Glass beads, such as SAE GB20 (~20 mm) glass beads, are impelled at the workpiece to peen the platform, the fillet, and the airfoil immediately adjacent thereto. Optionally, the entire blade may be peened as set forth below. An intensity of 0.25–0.30 N is used with the glass beads being preferably impelled by pneumatic force. Because the glass beads are small in diameter and because they inevitably include fragments of broken glass beads, the surface finish provided by this step will be of the order of 40 AA. (AA represents the surface roughness in $10^{-6}$ inch. Amer. Nat. Stds. Inst. B 46-l).

Other shot sizes may be used in the first and second peening steps, provided that they conform with the general requirements set forth. In the first step, it is required that the shot be of a nominal size such that the larger particles in the shot mass be of a diameter no more than half the fillet radius. It will be found that this necessitates a relatively small shot size, as is GB20. Other shot, such as steel shot SAE S110 (0.27 mm dia) may be used. Uniform steel shot may also optionally be used in the first step instead of the more common SAE specification types of materials which have relatively wide size distributions.

In the first step any means may be used which impells the shot at sufficient velocity to attain the needed intensity, including fluid entrainment, impellers, and gravity acceleration. However, whatever small diameter shot or impelling means is used, the surface finish will tend to be greater than 30 AA, as a result of obtaining the 0.25–0.30 N intensity.

In the second step, other sizes of uniform shot than 1.8 mm NL-18 shot may be used. Generally, the shot sizes which will be found usable will range from 1–2.5 mm diameter, with 1.5–2 mm diameter range being preferred.

In the second step, the use of gravity acceleration of the shot is preferred because the surface roughness is interdependent with both shot size and shot velocity. With gravity acceleration and its easily attainable uniform velocity, the optimum rate of production can be achieved. However, any other means which provide substantially uniform velocity may be used.

Figure 3:
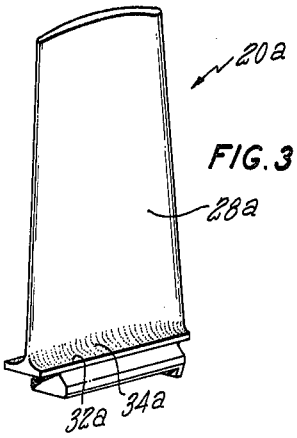
FIG. 3 illustrates the fillet region of a blade which is of importance to fatigue life.

There are two basic modes in which the foregoing duplex peening process may be employed. The first mode is illustrated by the finishing of one side of the blade 20*a* in FIG. 3. It comprises, in the first step, peening only of the fillet region 34*a* and nearby portions of the airfoil surface 28*a* and platform 32*a*. Then the second peening step is undertaken, to finish the entire portion of the blade where peening and smooth surfacing is desired, that is, the regions 28*a*, 34*a*, and 32*a* shown in the Figure. The peening intensities for the first and second step are substantially the same, presuming that substantially uniform peening intensity on the surfaces of the blade is required. Thus, it will be seen that the fillet region 34*a* will obtain its residual compressive stress from the first step. Nonetheless, during the second step peening with the larger media will impart a smooth surface finish to the fillet region. There probably will also be some additional compressive stressing as the data below indicates, notwithstanding the inferences of specifications such as AMS 2430.

Figure 4:
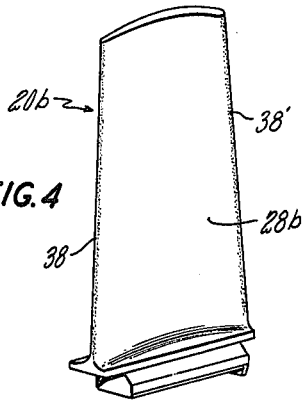
FIG. 4 illustrates the differences in peening and surface finish which are obtained in a blade peened in a duplex process where the fragile edges are not directly impacted in the second step.
Figure 2:
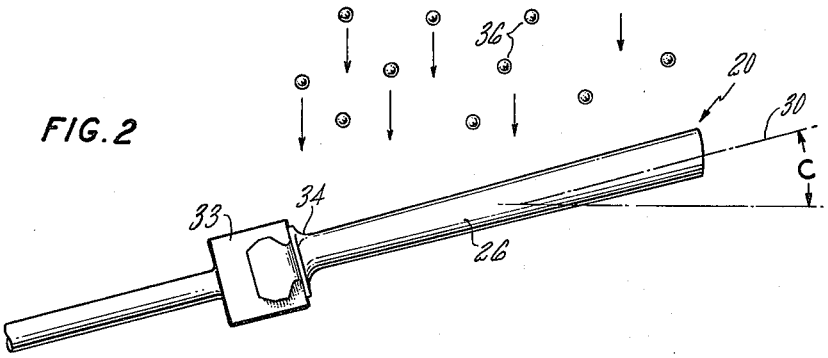
FIG. 2 shows the typical orientation of a blade while shot peening, to peen the fillet region.

The second mode of duplex peening comprises applying the first step peening to the entire surface of the blade which is to be finished. This is then followed by a second peening over substantially the entire surface of the airfoil using the larger media. The effect in the fillet region will be the same as that described for the first mode. Since both peening steps will be carried out for their respective saturation times, the preponderance of the workpiece in the second mode will have received a peening which is essentially equivalent to carrying out either one of the steps for twice the particular saturation time. This will result in higher peening intensity in the workpiece than either single step provides. (In the second step, it is also feasible in certain instances to use less than the intensity used in the first step. In this circumstance the primary effect of the second step would be smoothing, and there would be a rather small contribution to the residual stress of the workpiece.) A variation of the second mode of duplex peening is particularly useful for airfoils with very thin leading edges 38, 38' as shown for the airfoil 20*b* in FIG. 4. In such instances, the first peening step is applied to the entire workpiece surface. Then, the second peening step is accomplished according to the method set forth in our copending application Ser. No. 300,718 "Method of Peening Airfoils and Thin Edged Workpieces". Briefly, the airfoil is disposed as shown in FIG. 2 and oscillated about its longitudinal axis 30 in a manner which results in peening of the surface 28*b* but which avoids hard impacts on the leading edges 38, 38' for very thin edges, the avoidance of edge impacts in the second step will be such that, were it not for the first peening, the requisite peening intensity would not be achieved. Carrying out the second step in a manner which avoids impacting the edges 38, 38' is done when their fragility is such that impact by the relatively large media used in the second step would cause gross deformation of the edges. In this practice of the invention, it will be found that the extreme edges 38, 38' will have a somewhat inferior finish, compared to the finish which the preponderance of the blade has. However, the blade so finished will have superior properties to blades of the prior art which have been simply subjected to the first peening step or its equivalent. Not only will the bulk of the airfoil have the good smoothness provided by the second step, but the edges will be partially smoothed—to finishes in the 20 AA range—by glancing blows from the large shot.

Figure 5:
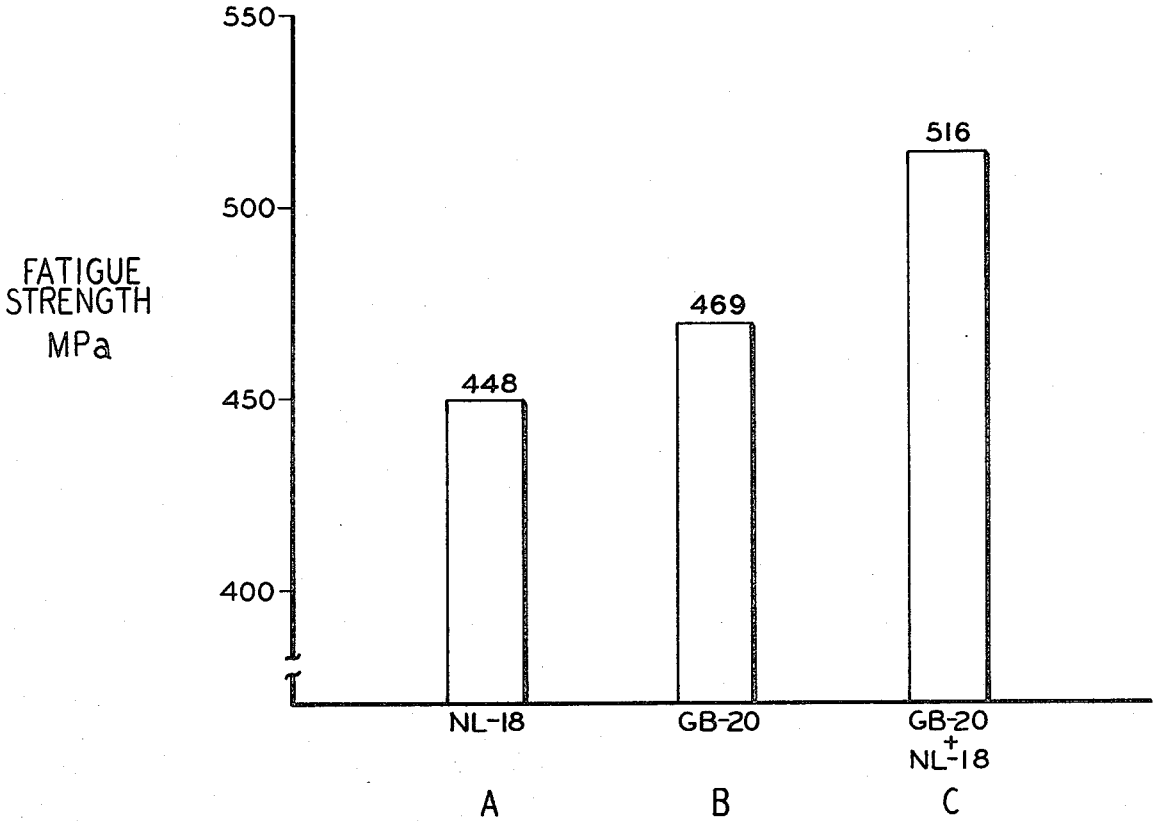
FIG. 5 shows the bending fatigue strength of blades peened in different ways.

High frequency fatigue tests have been conducted on blades which have been peened in accord with the modes of the invention. Basically, the tests were conducted at 25° C., with the blade being vibrated in its first cantilevered bending mode. A determination was made of the maximum stress which the part was capable of enduring for $10^7$ cycles. In the fatigue test, failure will occur in most instances in the fillet region of the blade. The test data are summarized in FIG. 5. Column A shows that blades which have been peened only with the large NL-18 steel shot have a certain fatigue life. This is slightly lower than the life shown in Column B, which represents blades peened only according to the first step, with GB20 glass beads. Column B strength is representative of the parts in the prior art. Column C shows the test data for blades which have been peened in the fillet area (either according to the first or second mode above, since properties away from the fillet region are not measured in the test) and it is seen that a significant improvement in fatigue life is provided by the duplex peening process. In a way, this is surprising since the test data seemed to show, in accord with hypothesis, that the second step peening (Column A) is inferior to the first step peening (Column B). But, as pointed out in one of our copending applications, the stress distributions in the workpiece are different, according to the size of the shot used. The larger shot provides a lower peak compressive stress, but the compressive stressing extends deeper into the workpiece. This suggests some explanation for the observations of evident cooperation between the two steps.

Although this invention has been shown and described with respect to a preferred embodiment, it will be understood by those skilled in the art that various changes in form and detail thereof may be made without departing from the spirit and scope of the claimed invention.

We claim:

1. The method of surface treating a workpiece to provide residual compressive stresses and smooth surfaces finish, which comprises (a) impacting a first portion of the workpiece with a first stream of shot, the shot having a mean diameter of less than about 1 mm, to provide the said first portion of the workpiece with a first set of residual stresses and a first surface finish;

(b) impacting a second portion of the workpiece with a second stream of shot, the shot having a substantially uniform diameter in the range 1–2.5 mm and a substantially uniform mass and velocity, to provide a second set of residual stresses and a second surface finish smoother than about 30 AA, said finish being smoother than the first surface finish, said second impacted portion overlapping at least in part the first impacted portion.

2. The method of claim 1 wherein the workpiece has a surface contour, such as a fillet, having a nominal inside radius, and where the nominal diameter of the first stream of shot is less than half said inside radius, and wherein the diameter of the second stream of shot is more than half said inside radius.

3. The method of claim 1 wherein the intensity of the second stream of shot is equal to the intensity of the first stream.

4. The method of claims 1, 2, or 3 wherein the first shot stream is at an intensity of about 0.25–0.30 mm N.

5. The method of claims 1 or 2 wherein the second stream of shot is comprised of particles having substantially uniform diameters in the range 1.5–2.0 mm.

6. The method of claim 1 wherein the first impacting step (a) is carried out using glass beads, and wherein the second step (b) is carried out using spherical steel shot accelerated by gravity.

7. An article produced by the method of claim 1 having greater fatigue strength than an article produced using either the first or the second step alone, the article having a peened surface finish smoother than 30 AA.

8. The method of surface treating a workpiece to provide residual compressive stresses and smooth surface finish, which comprises (a) impacting the entire surface of the workpiece with a first stream of shot, the shot having a mean diameter of less than about 1 mm, to provide the workpiece with a first set of residual stresses and a first surface finish;

(b) impacting a portion of the entire surface of the workpiece with a second stream of shot, the shot having a substantially uniform diameter in the range 1–2.5 mm and a substantially uniform mass and velocity, to provide the portion with a second set of residual stresses greater than the first set and a second surface finish smoother than the first surface finish and smoother than about 30 AA.

9. The method of claim 8 wherein the workpiece is an airfoil having edges and further comprising preventing the second stream of shot from impacting at least one of the edges.

* * * * *